US005664614A

United States Patent [19]

Debs

[11] Patent Number: 5,664,614

[45] Date of Patent: Sep. 9, 1997

[54] VENETIAN BLIND ASSEMBLY

[76] Inventor: Victor Debs, 65 Benedict Ave., Staten Island, N.Y. 10314

[21] Appl. No.: 636,310

[22] Filed: Apr. 23, 1996

[51] Int. Cl.[6] ..... E06B 9/30

[52] U.S. Cl. ..... 160/168.1

[58] Field of Search ..... 160/168.1 R, 173 R, 160/166.1 R, 172 R, 176.1 R, 178.1 R

[56] References Cited

U.S. PATENT DOCUMENTS

| | | | |
|---|---|---|---|
| 2,103,395 | 12/1937 | Wade et al. | 160/168.1 R |
| 2,572,291 | 10/1951 | Weaver | 160/168.1 R |
| 2,687,770 | 8/1954 | Walker et al. | 160/176.1 R |
| 2,748,852 | 6/1956 | Akerstrom | 160/168.1 R |
| 4,487,243 | 12/1984 | Debs | 160/176.1 R X |

*Primary Examiner*—David M. Purol
*Attorney, Agent, or Firm*—Londa and Traub LLP

[57] ABSTRACT

A venetian blind assembly is characterized by a unitary major pull cord for raising and lowering a bottom rail, the major cord extending from a head of the assembly to expose a first end by which a user may operate the major cord, the major cord being connected at a second end thereof to a minor cord at a connection point, which minor cord is connected to a bottom rail of the assembly, whereby a raising or lowering of the major cord in turn pulls the minor cord to thereby lower or raise the bottom rail, the connection point of the major and minor cords being located such that when the major cord is pulled toward a fully exposed position, the connection point is located either external of the head but in close proximity thereto or is located within the head. In a preferred embodiment, the minor cord is slidingly and threadingly connected to the major cord adjacent the second end thereof to form a loop of the minor cord having two free strands, which free strands are fixed to the bottom rail, whereby the free strands are moveable inversely in relation to each other by way of a sliding of the minor cord loop with respect to the major cord at the connection point to thereby effect an automatic leveling of the bottom rail.

3 Claims, 4 Drawing Sheets

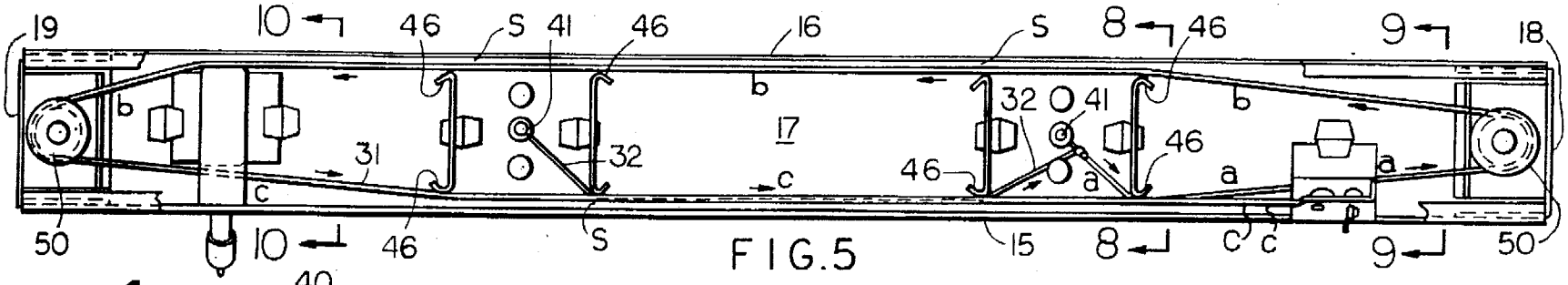
FIG.5
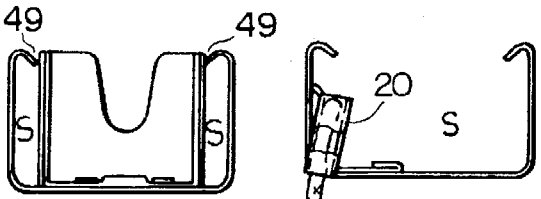
FIG.9
FIG.8
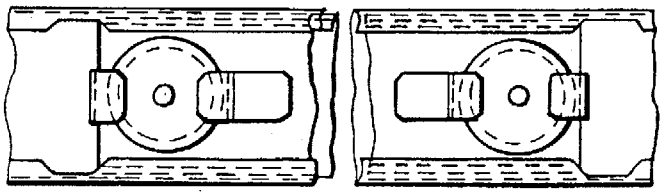
FIG.7
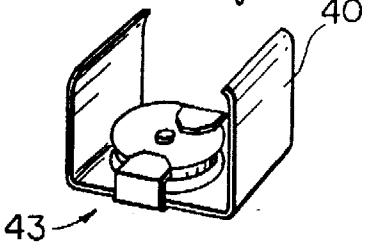
FIG.6
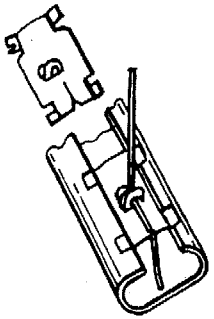
FIG.13
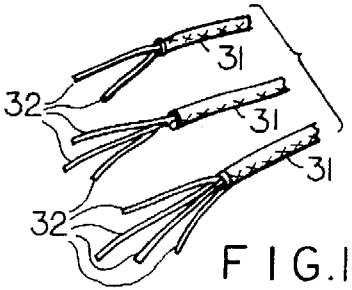
FIG.12
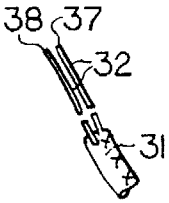
FIG.11c
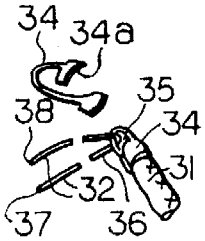
FIG.11b
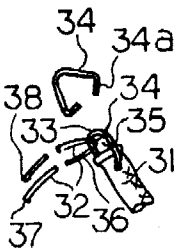
FIG.11a
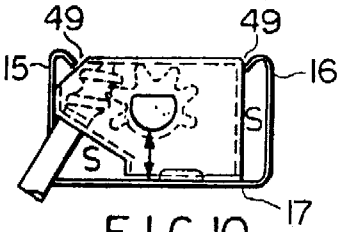
FIG.10

VENETIAN BLIND ASSEMBLY

BACKGROUND OF THE INVENTION

The present invention relates to a venetian blind assembly. In particular, the invention relates to the operational feature of a venetian blind assembly which acts to raise and lower the slats.

This particular feature has in the past been linked to accidents in the home by way of a characteristic feature of prior art assemblies, as will be discussed herein. The raising and lowering the slats of a blind is accomplished generally by way of a unitary cord having its two free ends fastened to the bottom rail or base, strung through the holes in the slats, through the head of the blind, and into and out of a cord lock, to form a loop exiting from the head. When the loop is pulled down, the bottom rail raises and collects the slats on the way up. When the bottom rail and slats are all the way up the cord lock is shifted to the locked position, thus securing the blind in opened status. However, when the blind is fully opened, the cord is correspondingly pulled down toward the floor, and collects with the rest of the cord on the floor making it extremely unsafe for anyone passing in proximity. Children, babies or animals may pass by the loop and get tangled, inadvertently pulling the cord so as to accidentally open the cord lock, thus releasing the blind downward with all its weight, which in turn pulls the pull cord (the loop) up with a sudden powerful motion, and possibly trapping a person or object in the loop with severe consequences.

It is therefore an object of the present invention to eliminate this problem of the hazardous pull cord loop.

SUMMARY OF THE INVENTION

Accordingly, the present inventor has invented a venetian blind assembly wherein the pull cord is unitary, thus eliminating the need for a pull cord loop.

A venetian blind assembly is characterized by a unitary major pull cord for raising and lowering a bottom rail, the major cord extending from a head of the assembly to expose a first end by which a user may operate the major cord, the major cord being connected at a second end thereof to a minor cord at a connection point, which minor cord is connected to a bottom rail of the assembly, whereby a raising or lowering of the major cord in turn pulls the minor cord to thereby lower or raise the bottom rail, the connection point of the major and minor cords being located such that when the major cord is pulled toward a fully exposed position, the connection point is located either external of the head but in close proximity thereto or is located within the head. In a preferred embodiment, the minor cord is slidingly and threadingly connected to the major cord adjacent the second end thereof to form a loop of the minor cord having two free strands, which free strands are fixed to the bottom rail, whereby the free strands are moveable inversely in relation to each other by way of a sliding of the minor cord loop with respect to the major cord at the connection point to thereby effect an automatic leveling of the bottom rail.

BRIEF DESCRIPTION OF THE DRAWINGS

The invention is illustrated by way of examples in the following drawings in which:

FIG. 5 is a top view of another embodiment of the present invasion.

FIG. 6 is a single pulley assembly.

FIG. 7 is a double pulley assembly.

FIG. 8 is a section taken on line 8—8 of FIG. 5.

FIG. 9 is a section taken on line 9—9 of FIG. 5.

FIG. 10 is a section taken on line 10—10 of FIG. 5.

FIG. 11*a*, 11*b*, and 11*c* show perspective views of three different embodiments of a terminal joining the minor chord and major chord, along with separate representations of the connecting means.

FIG. 12 consists of perspective view of three different embodiments of a multiple strand chord.

FIG. 13 is a perspective view of an assembly for receiving and controlling the length of the strand.

DETAILED DESCRIPTION OF THE INVENTION

Figure 1:
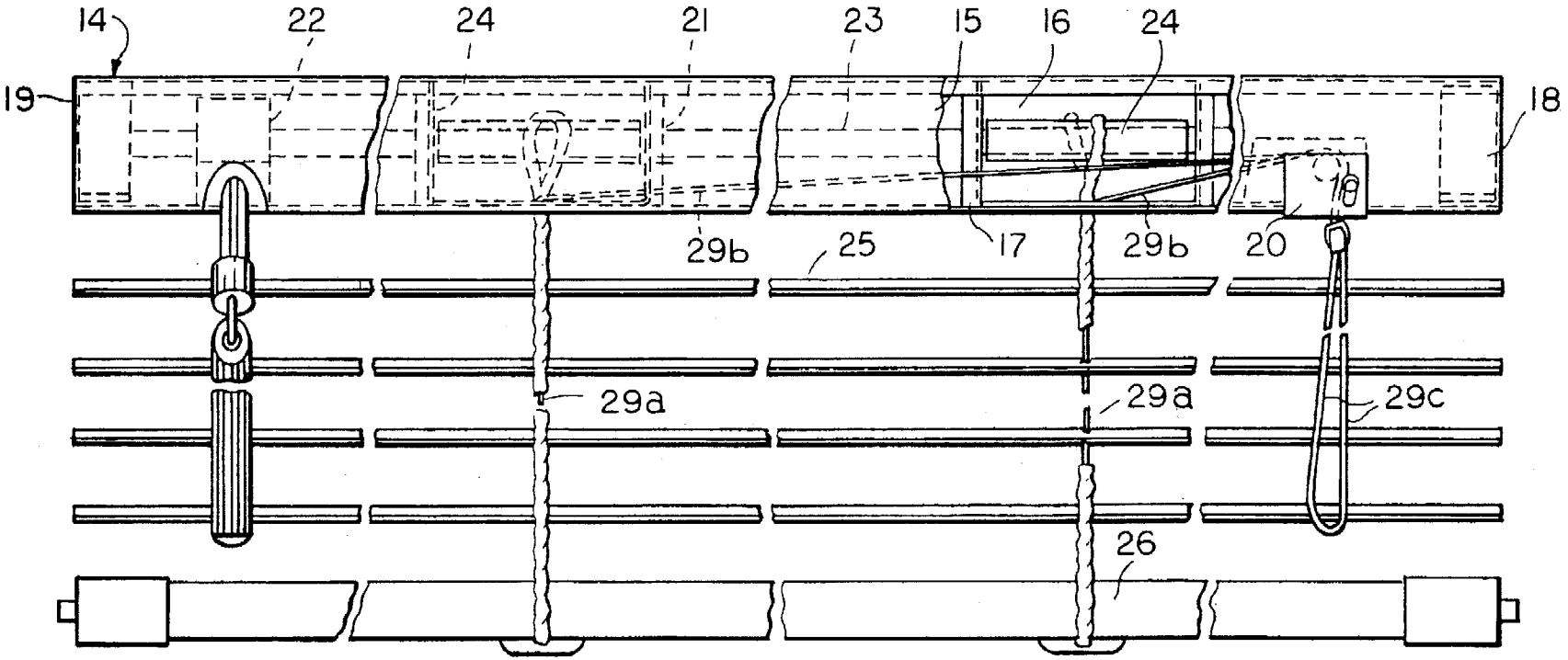
FIG. 1 PRIOR ART
FIG. 1 is a front view of a standard prior art blind in a closed position (i.e. blind extended) with the head partially cut away to expose the mechanism and operation of a pull cord loop.
Figure 2:
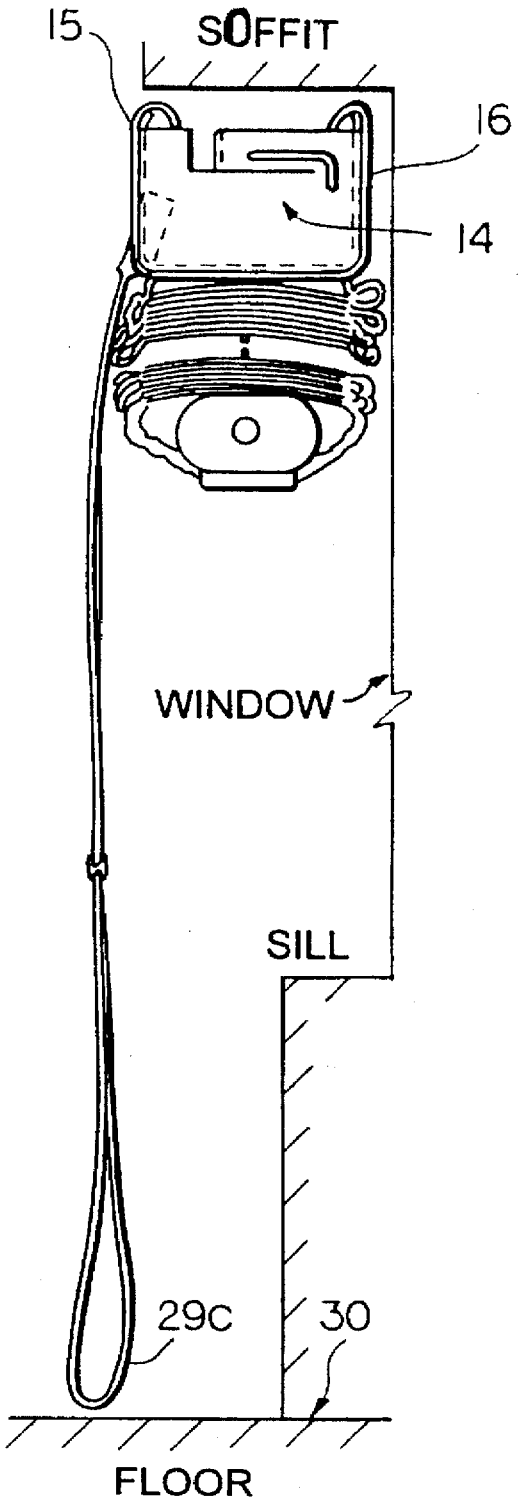
FIG. 2 PRIOR ART
FIG. 2 is a side view of FIG. 1 with the blind in a raised (i.e. opened) position.
Figure 3:
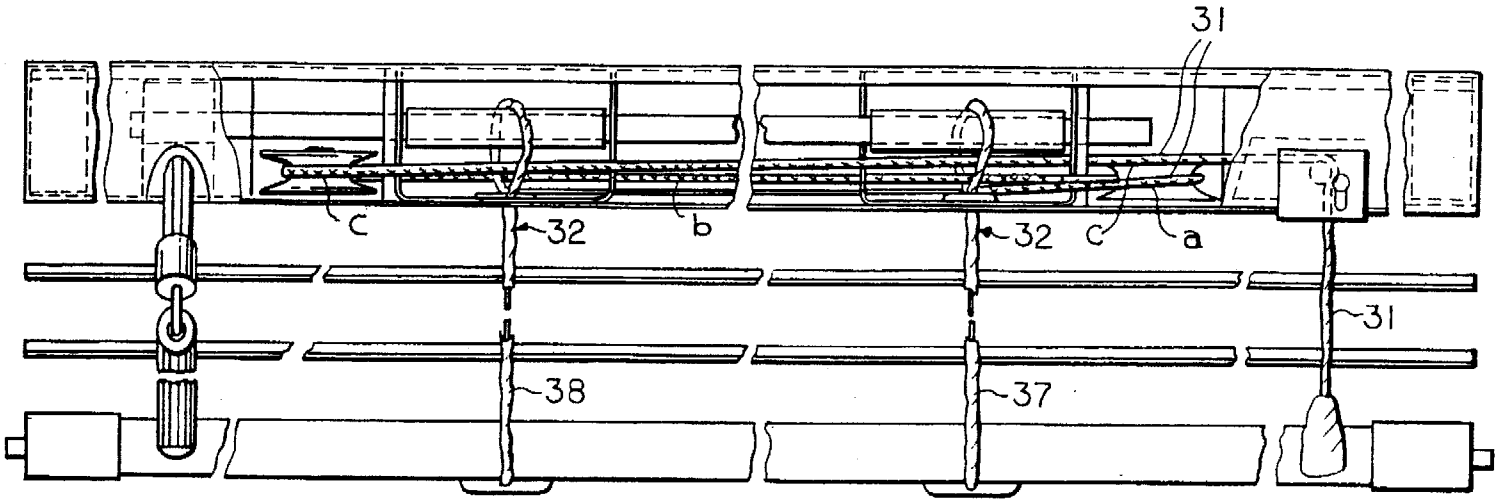
FIG. 3 is a front view of an embodiment of the present invention, with the head partially in section.

Referring now to the drawing in FIG. 1 showing a standard prior art blind assembly as shown in my U.S. Pat. No. 4,487,243, the front face 15 of the head 14 is partially exposed to show the rear face 16 and the bottom face 17. The blind assembly further includes standard parts such as end braces 18, 19, cord lock 20, tilt rod cradles 21, tilter 22, tilt rod 23, tape drums 24, slats 25 and bottom rail 26. The pull cord 29 is shown with its two free ends 29*a* running through the slats 25 and being fixed at their ends to the bottom rail 26 to thereby raise and lower the rail and slats, the cord pieces 29*b* then running inside the head 14 into the cord lock 20, and finally out of the cord lock to a position where the cord forms a loop 29*c* hanging from the assembly, which loop is pulled by the user to activate the blind. FIG. 2 shows the same prior art blind of FIG. 1, but in a position wherein the blind is pulled all the way to the top in an opened, locked position, whereby the loop 29*c* hangs dangerously on or near the floor 30.

In the assembly of the invention, shown in FIGS. 3–13, the loop 29*c* of the prior art is eliminated, and a unitary exposed pull cord portion 31 is instead utilized. In order to accomplish this, the single cord 29 of the prior art forming a loop is replaced by two cords, a relatively heavy cord identified here as the major cord 31 and a relatively light cord 32 identified as the minor cord. These venetian blind cords are usually made of synthetic material, such as nylon, Dacron™, Rayon™ etc. The cords are generally cut with a hot knife to create a well-sealed end which resists unraveling. These two cords 31, 32 are, in a first embodiment, joined together with connectors 34, as shown in FIGS. 11*a* and 11*b*, in which the connectors 34 are shown both separately and as part of the connection assembly with the cords. One side 34*a* of the connector is clamped at an end of the major cord 31 to form an aperture 35 in the manner of a needle eye through which the minor cord 32 is slidingly threaded. The minor cord thus forms a loop 36 at the connection portion, with the two free ends of cord 32 running from the loop portion 36 of the cord as cord portions 37, 38. Cord portions 37, 38 run through the slats and are fastened to the bottom rail in the manner of prior art cord portion 29*a*.

An alternate manner of joining the two cords 31 and 32 is to simply thread the minor cord 32 close to the sealed end of the major cord 31 by means of a specially made needle or machine to suit the purpose, as shown in FIG. 11*c*.

Figure 4:
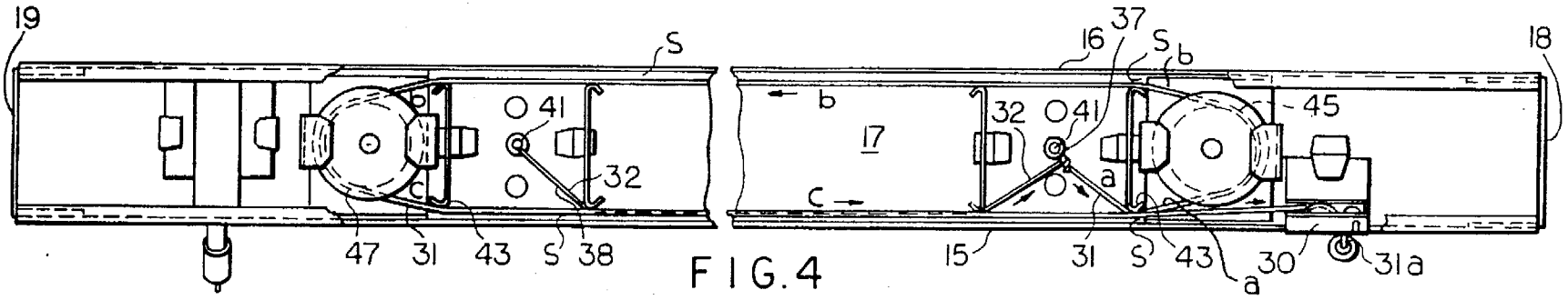
FIG. 4 is a top view of FIG. 3 showing and detailing the route of the pull cord inside the head.

As shown in FIG. 4, the minor cord loop 36 which is formed at the connection portion at the end of the major cord 31 is the starting point for the two free portions 37, 38 of cord 32, from which starting point the minor chord 32 runs down from the head through holes 41 in the bottom face of the head. The minor chord portions 37, 38 are strung down through the slats 42 and fastened to the bottom rail. The major cord 31 runs from its connection with the minor cord along path "a", through the space S provided between the front face 15 of the head and the vertical members of the cradle 43 closest to the cord lock 30. The major cord 31 then runs around first pulley 45 and (along path "b") through the space S provided between the rear side 16 of the head and the vertical members of the cradles 46, around second pulley 47 and then through the spaces S provided between the side of the head 15 and the vertical members of the cradles 43 (along path "c"). It may be necessary to wind the major cord over again along the same path until the total winding is equal to the length of the blind. The major cord 31 then passes through the cord lock 30, passing again through the spaces provided between the side of the head 15 and the vertical members of the cradles 43. The cord 31 then exits the cord lock 30 to the outside of the head at 31*a*, where it can be pulled by the user. It should be noted that all the routing and winding of the cord inside the head will be in the same direction so that no tangling of the cord will be possible at any time. Tabs 48 may be supplied to restrict the cords from escaping from the pulleys due to the operation, handling or shipping the blind.

When the major cord 31 is pulled downwardly by the user, the major cord 31 travels in the direction of the arrows along the path defined above. As a result, minor cord 32 is also pulled to the same degree to effect a lifting of the bottom rail and the slats. In the prior art design, the twin strands of the loop 29 each control the lifting of a respective side of the bottom rail, and hence it is often necessary to separately pull each strand of the loop 29 in order to ensure that each side of the bottom rail is leveled. This problem is eliminated in the present invention, which effects an automatic leveling of the bottom rail. As the major cord 31 is pulled along the winding path, minor cord 32 is pulled along. However, since minor cord 32 may slip through the aperture 35 of the connector 34, the free ends 37, 38 will be self-adjusting based on the equal gravitational pull of both ends of the bottom rail, and an automatic leveling will result (this of course presumes that the free ends 37, 38 are connected at symmetrical points along the bottom rail with respect to a center point thereof). To facilitate the feeding of the cords in the head, all the hardware parts involved should have enough clearance 49 between themselves and the beads of the head, which clearance should be flexible enough to allow an insertion of the cord through into the spaces S as shown in FIGS. 7, 8 and 9 but not enough for the cords to escape due to shipping and handling.

With reference to FIG. 5, an alternate routing of the cord in the head can be arranged wherein the pulleys 50 can be mounted on the end braces, to provide more distance between the pulleys. As shown in FIG. 7, a further embodiment can be employed, which avoids the necessity for redesigning the head of the prior art or altering any of the internal hardware, by inserting a bracket 52 with two pulleys and positioning the bracket between two cradles, thus achieving the goal of the invention while making only minimum use of the spaces provided by the cradles. The first embodiment, discussed above with reference to FIG. 3, employs two single pulley brackets 43 (see FIG. 6). Furthermore, it can be seen that an arrangement can be provided employing the connection of FIG. 11, wherein the single minor cord is threadingly looped at an end of the major cord, but without the pulleys, thus resulting in a direct, but still self-correcting operation. It will be apparent that the use of a pulley system is preferable, in order to obtain a smoother, easier, operation of the assembly.

Another embodiment of the present invention which also eliminates the need for an external loop pull cord uses a major cord 31 which consists of two or more minor cord strands wound together, as shown in three different embodiments of FIG. 12. Thus, the major cord operating as the pull cord is unitary and therefore loopless. The minor strands run through the head and are connected to the bottom rail in a known manner, e.g. as shown in connection with FIG. 1. Since the minor cords become tightly bound together at the junction with the major cord, adjustment of the minor cord positions with respect to the bottom rail attachment should not be necessary once fixed during manufacture. This fixation can be made adjustable by way of locking adjustment brackets positioned in the bottom rail, as shown in FIG. 13.

In any of the above embodiments, it is preferred of course in keeping with the object of the invention, to have the connection point located inside of the head, whereby only the unitary major cord extends outside. This will eliminate the inherent danger of getting caught in a dangling loop. If the locking means is sufficiently flexible to allow smooth passage therethrough of the connection point between the major and minor cords, the connection point may be situated slightly below the head, but external of the head, so long as the connection point does not sit low enough to allow for inadvertent catching.

It will be apparent to those skilled in the art that minor modifications can be made without departing from the scope of the invention.

I claim:

1. A venetian blind assembly comprising a unitary major pull cord for raising and lowering a bottom rail, the major cord extending from a head of the assembly to expose a first end by which a user may operate the major cord, the major cord being connected at a second end thereof to a minor cord at a connection point, which minor cord is connected to a bottom rail of the assembly, whereby a raising or lowering of the major cord in turn pulls the minor cord to thereby lower or raise the bottom rail, the connection point of the major and minor cords being located such that when the major cord is pulled toward a fully exposed position, the connection point is located either external of the head but in close proximity thereto or is located within the head wherein the minor cord is slidingly and threadingly connected to the major cord adjacent the second end thereof to form a loop of the minor cord having two free strands, which free strands are fixed to the bottom rail, whereby the free strand are moveable inversely in relation to each other by way of a sliding of the minor cord loop with respect to the major cord at the connection point to thereby effect an automatic leveling of the bottom rail.

2. The venetian blind assembly of claim 1, wherein the major cord extends into the head such that the connection point is located within the head.

3. The venetian blind assembly of claim 1, wherein the major cord extends into the head through a locking means and winds through the head about a system of pulleys before connecting to the minor cord.

* * * * *